US010138581B2

(12) United States Patent
Poon

(10) Patent No.: US 10,138,581 B2
(45) Date of Patent: Nov. 27, 2018

(54) WOVEN FABRIC AND METHOD OF MAKING SAME

(71) Applicant: Twin Dragon Marketing, Inc., Gardena, CA (US)

(72) Inventor: Dominic Kin-Ming Poon, Manhattan Beach, CA (US)

(73) Assignee: Twin Dragon Marketing, Inc., Gardena, CA (US)

( * ) Notice: Subject to any disclaimer, the term of this patent is extended or adjusted under 35 U.S.C. 154(b) by 171 days.

(21) Appl. No.: 15/418,585

(22) Filed: Jan. 27, 2017

(65) Prior Publication Data

US 2017/0211211 A1 Jul. 27, 2017

Related U.S. Application Data

(60) Provisional application No. 62/287,776, filed on Jan. 27, 2016.

(51) Int. Cl.

| | |
|---|---|
| ***D03D 15/08*** | (2006.01) |
| ***D03D 15/00*** | (2006.01) |
| ***D03D 15/04*** | (2006.01) |
| ***D03D 13/00*** | (2006.01) |

(52) U.S. Cl.

CPC ..... *D03D 15/08* (2013.01); *D03D 13/004* (2013.01); *D03D 13/008* (2013.01); *D03D 15/0033* (2013.01); *D03D 15/04* (2013.01); *D10B 2201/02* (2013.01)

(58) Field of Classification Search

None

See application file for complete search history.

(56) References Cited

U.S. PATENT DOCUMENTS

| | | | | |
|---|---|---|---|---|
| 9,365,958 | B2 * | 6/2016 | Yenici | D03D 1/00 |
| 2011/0212659 | A1 * | 9/2011 | Yenici | D03D 15/04 442/184 |
| 2013/0048140 | A1 * | 2/2013 | Yenici | D03D 15/04 139/422 |
| 2015/0034205 | A1 * | 2/2015 | Yenici | D03D 1/00 139/421 |
| 2015/0038042 | A1 * | 2/2015 | Erkus | D03D 1/00 442/203 |
| 2015/0122368 | A1 * | 5/2015 | Poon | D02G 3/04 139/420 R |
| 2016/0083877 | A1 * | 3/2016 | Kalfa Kilickan | B32B 5/22 442/184 |

* cited by examiner

*Primary Examiner* — Bobby Muromoto, Jr.

(74) *Attorney, Agent, or Firm* — Sheppard, Mullin, Richter & Hampton LLP

(57) ABSTRACT

A woven fabric that includes a plurality of warp yarns and a plurality of stretch weft yarns. In one embodiment, all of the weft yarns have the same shrinkage ratio and same size of yarn count, and the repeat intersection points on the weft yarns are either 6×1 or 13×1. The weft yarns in the 6×1 pattern alternate with the weft yarns in the 13×1 pattern, with two 6×1 weft yarns followed by one 13×1 weft yarn. This results in a woven fabric that performs like a knitted fabric but with the look of woven denim when the warp yarns are indigo dyed.

20 Claims, 3 Drawing Sheets

FACE OF THE WOVEN TERRY

6733A1

WOVEN FABRIC AND METHOD OF MAKING SAME

CROSS-REFERENCE TO RELATED APPLICATIONS

This application claims priority to U.S. Provisional Application No. 62/287,776, filed Jan. 27, 2016, entitled "WOVEN FABRIC AND METHOD OF MAKING SAME," the entire contents of which are hereby incorporated by reference as if fully set forth herein.

TECHNICAL FIELD

The disclosed technology relates generally to woven fabrics, and, more particularly, some embodiments relate to woven fabrics having stretch weft yarns.

DESCRIPTION OF RELATED ART

Attempts have been made to produce a fabric that looks, feels, and performs like a knitted fabric, but is created through weaving. One such example is shown in U.S. Patent Application Publication No. 2011/0212659 to Hamit Yenici et al. Another such example is shown in U.S. Patent Application Publication No. 2013/0048140 to Hamit Yenici et al.

Both of these U.S. patent application publications to H. Yenici teach a fabric with wefts that include hard yarns and elastomeric yarns in a predetermined arrangement. At least one hard yarn is alternately arranged with at least one elastomeric yarn, the elastomeric yarns having a greater shrinkage ratio than that of the hard yarns. The hard yarns form under portions and over portions with respect to the warp yarns. The under portions are formed when the hard yarns pass along the back side of the warp yarns, defining loop portions. The over portions are formed when the hard yarns pass along the front side of the warps, defining connection portions. The elastomeric yarns form under portions and over portions with respect to the warp yarns in a weave that is tighter than the weave of the hard yarns.

Such fabrics have been found to have less-than-optimal performance respecting their elasticity and/or appearance, among other things. There is thus a need for a better-performing woven fabric that performs like a knitted fabric.

SUMMARY

Various embodiments of the present disclosure include a woven fabric comprising a plurality of warp yarns and a plurality of weft yarns woven through the plurality of warp yarns. A first set of the plurality of weft yarns are woven through the plurality of warp yarns in a 6×1 pattern, and a second set of the plurality of weft yarns are woven through the plurality of warp yarns in a 13×1 pattern.

In an embodiment, each of the plurality of weft yarns is in either the first set or the second set.

In an embodiment, the plurality of weft yarns in the first set and the second set are arranged in a repeating pattern.

In an embodiment, the repeating pattern comprises two weft yarns woven in the 6×1 pattern followed by one weft yarn woven in the 13×1 pattern.

In an embodiment, the plurality of warp yarns comprise Ne 16/1 to Ne 32/1 ring-spun, 100-percent cotton, indigo-dyed yarns, and the plurality of weft yarns comprise 19/1 to 32/1 TR blended plus 40 Denier lycra spun yarn.

In an embodiment, the plurality of warp yarns have a warp yarn density of approximately 90 ends per inch after weaving, and the plurality of warp yarns have a warp yarn density between approximately 110 ends per inch to approximately 170 ends per inch after shrinking.

In an embodiment, the plurality of weft yarns have a weft yarn density of approximately 90 picks per inch after weaving, and the plurality of weft yarns have a weft yarn density between approximately 96 ends per inch to approximately 114 ends per inch after shrinking.

In an embodiment, the woven fabric has a fabric weight between approximately 7 ounces to 9 ounces per square yard.

In an embodiment, the plurality of warp yarns have a thickness between 16 S to 32 S, and the plurality of weft yarns have a thickness between 19 S to 32 S.

In an embodiment, the plurality of weft yarns have the same size of yarn count under the same tension, and perform with the same shrinkage ratio.

Various embodiments of the present disclosure include a method of weaving a woven fabric comprising weaving a first plurality of weft yarns through a plurality of warp yarns in a 6×1 pattern and weaving a second plurality of weft yarns through the plurality of warp yarns in a 13×1 pattern. The first plurality of weft yarns and the second plurality of weft yarns are arranged in a repeating pattern.

In an embodiment, the repeating pattern comprises two weft yarns woven in the 6×1 pattern followed by one weft yarn woven in the 13×1 pattern.

In an embodiment, the plurality of warp yarns comprise Ne 16/1 to Ne 32/1 ring-spun, 100-percent cotton, indigo-dyed yarns, and the first and second pluralities of weft yarns comprise 19/1 to 32/1 TR blended plus 40 Denier lycra spun yarn.

In an embodiment, the plurality of warp yarns have a warp yarn density of approximately 90 ends per inch after weaving, and the plurality of warp yarns have a warp yarn density between approximately 110 ends per inch to approximately 170 ends per inch after shrinking.

In an embodiment, the first and second pluralities of weft yarns have a weft yarn density of approximately 90 picks per inch after weaving, and the first and second pluralities of weft yarns have a weft yarn density between approximately 96 ends per inch to approximately 114 ends per inch after shrinking.

In an embodiment, the plurality of warp yarns have a thickness between 16 S to 32 S, and the first and second pluralities of weft yarns have a thickness between 19 S to 32 S.

In an embodiment, the first and second pluralities of weft yarns have the same size of yarn count under the same tension and perform with the same shrinkage ratio.

In an embodiment, the first and second pluralities of weft yarns are woven through the plurality of warp yarns using a dobby-type weaving loom having a weft selection system.

In an embodiment, the method further comprises wetting the woven fabric and stretching the woven fabric in a warp direction to allow the woven fabric to shrink in a weft direction.

In an embodiment, the method further comprises heat setting the woven fabric.

It should be appreciated that many other features, applications, embodiments, and/or variations of the disclosed technology will be apparent from the accompanying drawings and from the following detailed description. Additional and/or alternative implementations of the structures, systems, non-transitory computer readable media, and methods described herein can be employed without departing from the principles of the disclosed technology.

DETAILED DESCRIPTION OF THE EMBODIMENTS

Embodiments of the technology disclosed herein are directed toward woven fabrics and methods for making woven fabrics. More particularly, the various embodiments of the technology disclosed herein relate to woven fabrics having stretch weft yarns.

Figure 1:
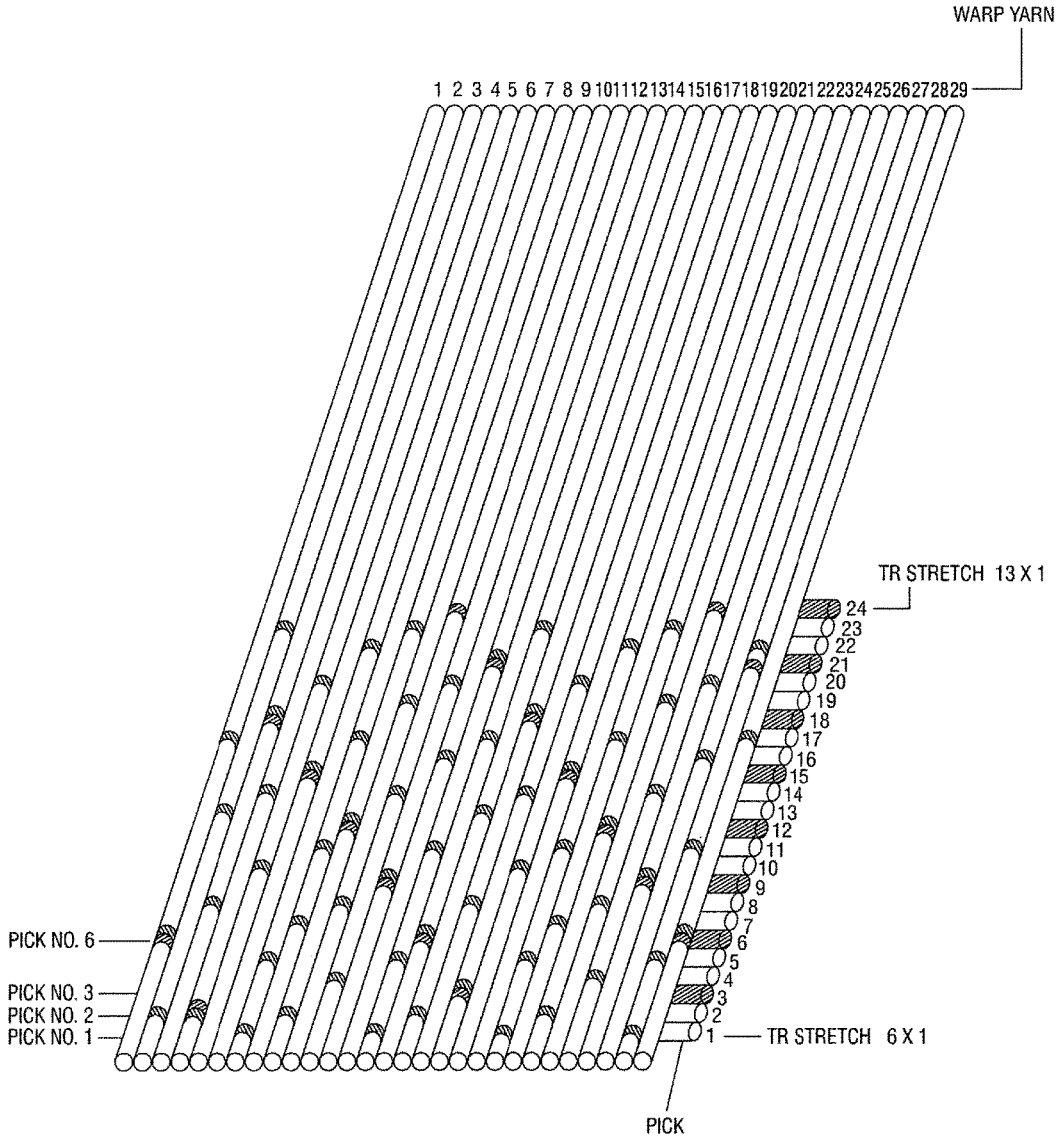
FIG. 1 shows a front perspective view of a woven fabric in accordance with one embodiment of the technology described herein.
Figure 2:
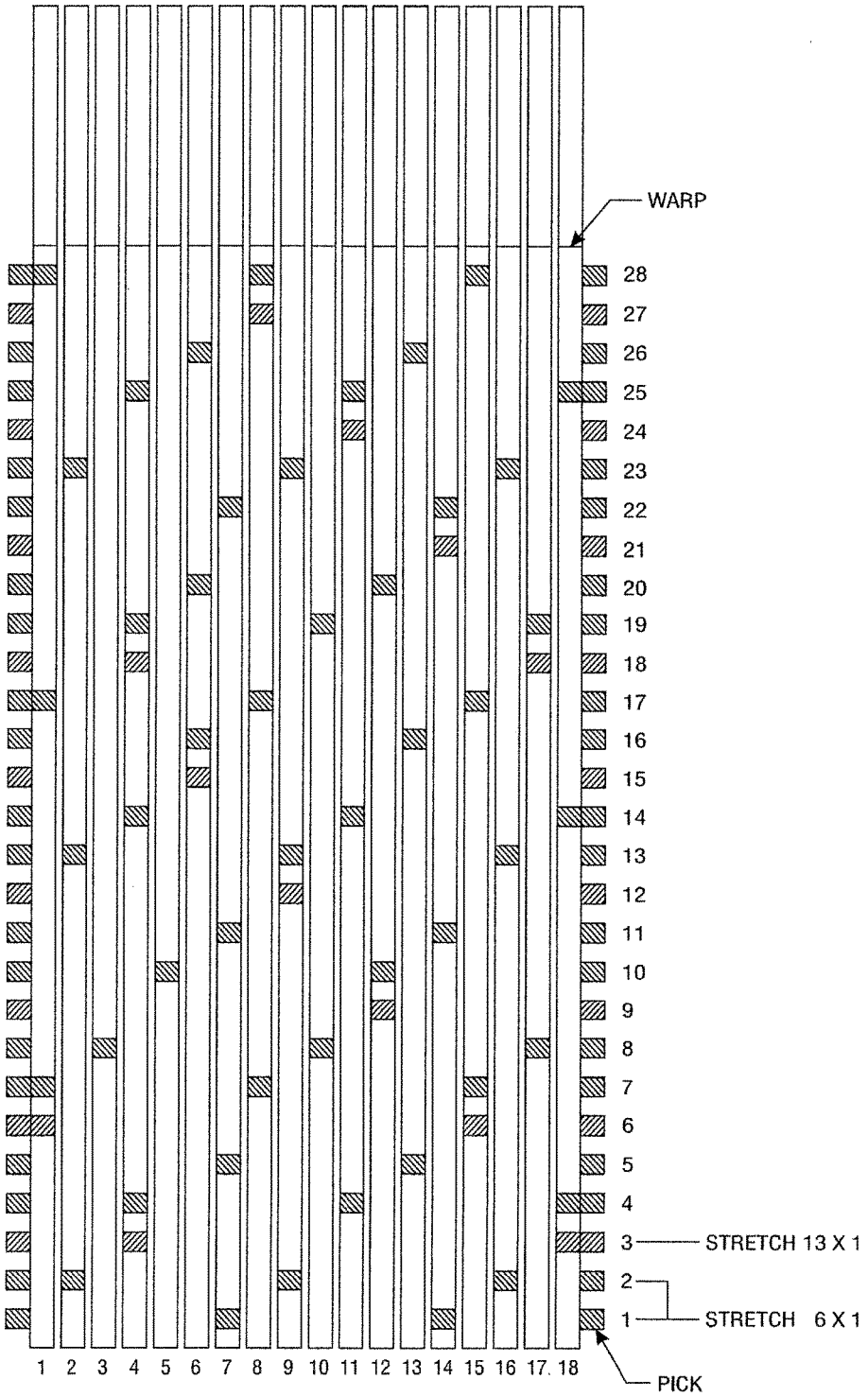
FIG. 2 shows a front face view of a woven fabric in accordance with one embodiment of the technology described herein.
Figure 3:
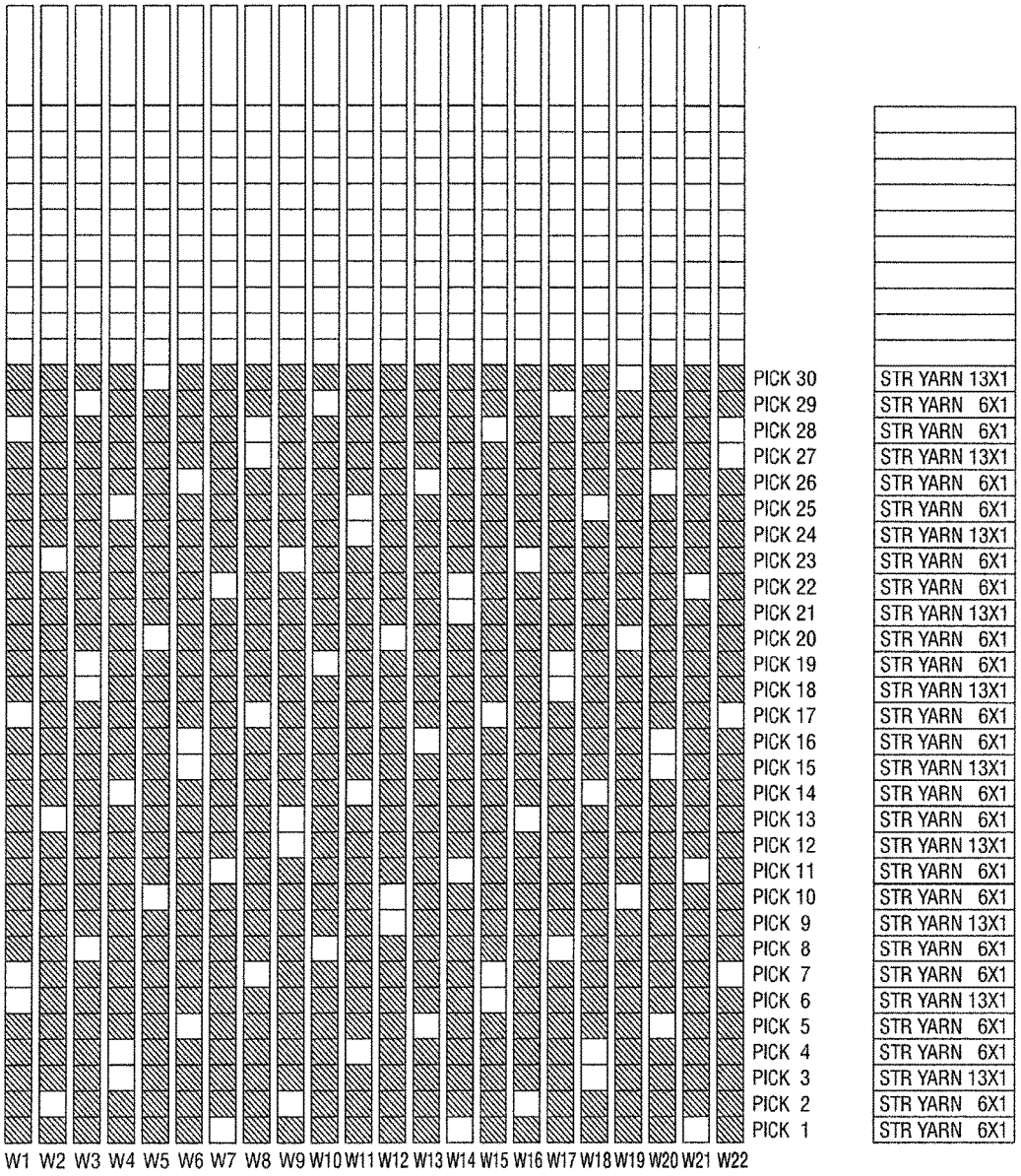
FIG. 3 shows a weaving pattern for a woven fabric in accordance with one embodiment of the technology described herein.

FIGS. 1-3 depict a woven fabric in accordance with one embodiment of the technology described herein. The woven fabric includes a plurality of warp yarns and a plurality of stretch weft yarns. In FIGS. 1-3, the warp yarns are represented by the numbers running along the horizontal X-axis, while the plurality of weft yarns are represented by the numbers running along the vertical Y-axis. For example, warp yarn 1 extends vertically, while weft yarn 1 extends horizontally.

In the weaving pattern, the weft yarns are woven in front of and in back of the warp yarns to create the woven fabric. For example, weft yarn 1 is woven in back of warp yarns 1-6 and in front of warp yarn 7, and then woven in back of warp yarns 8-13, and in front of warp yarn 14, and so forth. In certain embodiments, all of the weft yarns have the same shrinkage ratio and the same size of yarn count.

As shown in the figures, the repeat intersection points on the weft yarns are either 6×1 or 13×1. In other words, some of the weft yarns have 6 warp yarns across on the back side of the fabric, followed by 1 warp yarn across on the front side of the fabric (e.g., warp yarn 1, warp yarn 2, warp yarn 4, warp yarn 5, etc.). The other weft yarns have 13 warp yarns across on the back side of the fabric, followed by 1 warp yarn across on the front side of the fabric (e.g., warp yarn 3, warp yarn 6, warp yarn 9, etc.).

As shown in the figures, weft yarns 1,2, 4, 5, 7, 8, 10, 11, 13, 14, 16, 17, 19, 20, 22, 23, 25, 26, 28 and 29 are woven in the 6×1 pattern. Weft yarns 3, 6, 9, 12, 15, 18, 21, 24, 27 and 30 are woven in the 13×1 pattern. In the embodiment shown in FIGS. 1-3, the weft yarns in the 6×1 pattern alternate with the weft yarns in the 13×1 pattern, with two 6×1 weft yarns followed by one 13×1 weft yarn. The embodiment of FIGS. 1-3 results in a woven fabric that performs like a knitted fabric but with the look of woven denim when the warp yarns are indigo dyed.

In one embodiment, the warp yarns are Ne 16/1 to Ne 32/1 ring-spun, 100-percent cotton, indigo-dyed yarns. The stretch weft yarns are 19/1 to 32/1 TR blended plus 40 Denier lycra spun yarn. The warp-yarn density is approximately 90 ends per inch after weaving and approximately 110 ends per inch to approximately 170 ends per inch after shrinking. The weft-yarn density is approximately 90 picks per inch after weaving and approximately 96 ends per inch to approximately 114 ends per inch after shrinking. The fabric weight is 7 ounces to 9 ounces per square yard. The thickness range of the warp yarns is 16 S to 32 S. The thickness range of the weft yarns is 19 S to 32 S. All of the weft yarns use the same size of yarn count under the same tension and perform with the same shrinkage ratio. A dobby-type weaving loom having a weft selection system can be used for the weaving. After weaving, the fabric may be wetted and stretched in the warp direction to allow the fabric to shrink in the weft direction, with the stretch weft yarns pulling the warp yarns closer together. After shrinking, the fabric may be heat set to reduce shrinking in further washings.

While various embodiments of the disclosed technology have been described above, it should be understood that they have been presented by way of example only, and not of limitation. Likewise, the various figures may depict an example configuration for the disclosed technology, which is done to aid in understanding the features and functionality that can be included in the disclosed technology. The disclosed technology is not restricted to the illustrated example configurations, but the desired features can be implemented using a variety of alternative configurations. It is therefore intended that the scope of the invention be limited not by this detailed description, but rather by any claims that issue on an application based hereon. Accordingly, the disclosure of the embodiments of the invention is intended to be illustrative, but not limiting, of the scope of the invention, which is set forth in the following claims.

The invention claimed is:

1. A woven fabric comprising:

a plurality of warp yarns; and a plurality of weft yarns woven through the plurality of warp yarns, wherein a first set of the plurality of weft yarns are woven through the plurality of warp yarns in a 6×1 pattern, and a second set of the plurality of weft yarns are woven through the plurality of warp yarns in a 13×1 pattern.

2. The woven fabric of claim 1, wherein each of the plurality of weft yarns is in either the first set or the second set.

3. The woven fabric of claim 1, wherein the plurality of weft yarns in the first set and the second set are arranged in a repeating pattern.

4. The woven fabric of claim 3, wherein the repeating pattern comprises two weft yarns woven in the 6×1 pattern followed by one weft yarn woven in the 13×1 pattern.

5. The woven fabric of claim 1, wherein the plurality of warp yarns comprise Ne 16/1 to Ne 32/1 ring-spun, 100-percent cotton, indigo-dyed yarns, and the plurality of weft yarns comprise 19/1 to 32/1 TR blended plus 40 Denier lycra spun yarn.

6. The woven fabric of claim 1, wherein the plurality of warp yarns have a warp yarn density of approximately 90 ends per inch after weaving, and the plurality of warp yarns have a warp yarn density between approximately 110 ends per inch to approximately 170 ends per inch after shrinking.

7. The woven fabric of claim 1, wherein the plurality of weft yarns have a weft yarn density of approximately 90 picks per inch after weaving, and the plurality of weft yarns have a weft yarn density between approximately 96 ends per inch to approximately 114 ends per inch after shrinking.

8. The woven fabric of claim 1, wherein the woven fabric has a fabric weight between approximately 7 ounces to 9 ounces per square yard.

9. The woven fabric of claim 1, wherein the plurality of warp yarns have a thickness between 16 S to 32 S, and the plurality of weft yarns have a thickness between 19 S to 32 S.

10. The woven fabric of claim 1, wherein the plurality of weft yarns have the same size of yarn count under the same tension, and perform with the same shrinkage ratio.

11. A method of weaving a woven fabric comprising:

weaving a first plurality of weft yarns through a plurality of warp yarns in a 6×1 pattern; and weaving a second plurality of weft yarns through the plurality of warp yarns in a 13×1 pattern, wherein the first plurality of weft yarns and the second plurality of weft yarns are arranged in a repeating pattern.

12. The method of claim 11, wherein the repeating pattern comprises two weft yarns woven in the 6×1 pattern followed by one weft yarn woven in the 13×1 pattern.

13. The method of claim 11, wherein the plurality of warp yarns comprise Ne 16/1 to Ne 32/1 ring-spun, 100-percent cotton, indigo-dyed yarns, and the first and second pluralities of weft yarns comprise 19/1 to 32/1 TR blended plus 40 Denier lycra spun yarn.

14. The method of claim 11, wherein the plurality of warp yarns have a warp yarn density of approximately 90 ends per inch after weaving, and the plurality of warp yarns have a warp yarn density between approximately 110 ends per inch to approximately 170 ends per inch after shrinking.

15. The method of claim 11, wherein the first and second pluralities of weft yarns have a weft yarn density of approximately 90 picks per inch after weaving, and the first and second pluralities of weft yarns have a weft yarn density between approximately 96 ends per inch to approximately 114 ends per inch after shrinking.

16. The method of claim 11, wherein the plurality of warp yarns have a thickness between 16 S to 32 S, and the first and second pluralities of weft yarns have a thickness between 19 S to 32 S.

17. The method of claim 11, wherein the first and second pluralities of weft yarns have the same size of yarn count under the same tension and perform with the same shrinkage ratio.

18. The method of claim 11, wherein the first and second pluralities of weft yarns are woven through the plurality of warp yarns using a dobby-type weaving loom having a weft selection system.

19. The method of claim 11 further comprising:

wetting the woven fabric, and stretching the woven fabric in a warp direction to allow the woven fabric to shrink in a weft direction.

20. The method of claim 11 further comprising heat setting the woven fabric.

* * * * *